US011185876B2

(12) United States Patent
Dumont et al.

(10) Patent No.: US 11,185,876 B2
(45) Date of Patent: Nov. 30, 2021

(54) ATTACHMENT SYSTEM FOR MOUNTING A DISPENSING PUMP ON A VIAL AND ASSOCIATED VIAL OF FLUID PRODUCT

(71) Applicant: Albea Services, Gennevilliers (FR)

(72) Inventors: Pierre Dumont, Dargnies (FR); Frédéric Leleu, Le Treport (FR); Emir Ezzina, Montigny-le-Bretonneux (FR)

(73) Assignee: Silgan Dispensing Systems Le Treport

( * ) Notice: Subject to any disclaimer, the term of this patent is extended or adjusted under 35 U.S.C. 154(b) by 0 days.

(21) Appl. No.: 16/724,149

(22) Filed: Dec. 20, 2019

(65) Prior Publication Data

US 2020/0197964 A1 Jun. 25, 2020

(30) Foreign Application Priority Data

Dec. 20, 2018 (FR) ..... 1873690

(51) Int. Cl.
*B05B 11/00* (2006.01)

(52) U.S. Cl.
CPC ..... *B05B 11/0008* (2013.01); *B05B 11/3049* (2013.01)

(58) Field of Classification Search
CPC . B05B 11/0008; B05B 11/3049; B05B 11/30; B05B 11/3045
See application file for complete search history.

(56) References Cited

U.S. PATENT DOCUMENTS 5,348,174 A * 9/1994 Velicka ..... B05B 11/3049 215/277
6,394,318 B1 * 5/2002 Klodzinski ..... B05B 11/3049 222/321.7
2011/0024465 A1 * 2/2011 Roosel ..... B05B 11/3049 222/321.1
2012/0024899 A1 * 2/2012 Michaux ..... B65D 83/22 222/153.13

(Continued)

*Primary Examiner* — Vishal Pancholi
*Assistant Examiner* — Bob Zadeh

(57) ABSTRACT

The invention relates to a system for attaching a dispensing pump on the neck of a reservoir containing a fluid product. The system a sleeve with attachment means on the neck and hooking means of the pump, an articulation collar, the articulation collar and sleeve being mounted mobile with respect to one another between an end of motion position ($P_F$) and a start of motion position ($P_I$), a shrink ring configured to move along the articulation collar between a top disassembly position ($P_H$), wherein the attachment means are free, and a bottom position ($P_B$) of use, wherein the attachment means are engaged around the neck and wherein the start and end of motion positions ($P_I$, $P_F$) are arranged so that the articulation collar can go from the top disassembly position ($P_H$) to the bottom position ($P_B$) of use by a translational motion.

15 Claims, 4 Drawing Sheets

(56) References Cited

U.S. PATENT DOCUMENTS

| | | | | |
|---|---|---|---|---|
| 2012/0285991 | A1* | 11/2012 | Muller | B05B 11/3001 222/113 |
| 2012/0318825 | A1* | 12/2012 | Beranger | B05B 11/3049 222/321.1 |
| 2013/0118641 | A1* | 5/2013 | Beranger | B05B 11/001 141/363 |
| 2016/0175865 | A1* | 6/2016 | Dumont | B05B 11/3052 222/153.04 |
| 2020/0197964 | A1* | 6/2020 | Dumont | B05B 11/0008 |

* cited by examiner

ATTACHMENT SYSTEM FOR MOUNTING A DISPENSING PUMP ON A VIAL AND ASSOCIATED VIAL OF FLUID PRODUCT

CROSS REFERENCE TO RELATED APPLICATIONS

This application claims priority under 35 U.S.C. § 119(a) to French patent application number 1873690, filed on Dec. 20, 2018, the entire teachings of which are incorporated herein by reference.

BACKGROUND OF THE INVENTION

Field of the Invention

The invention relates to an attachment system of a pump dispensing a fluid product, and more particularly to the associated vial of fluid product, such as a cosmetic product, a pharmaceutical product, or any other type of product.

Description of the Related Art

Conventionally, vials of fluid product include a reservoir for the fluid product, with on top of its upper part, a rigid neck delimiting an opening wherein is inserted the system for dispensing the fluid product. The dispensing system includes a pump that can be actuated by a user pressing on a push button, which enables to dispense a dose of the fluid product, in particular in the form of spray. The dispensing system further includes attachment and sealing means that maintain it at the level of the neck and, as necessary, insulate the reservoir from the external environment. Among various existing configurations, attachment means enabling a definitive attachment of the dispensing system at the level of the neck should be distinguished from attachment means that require a threshold force to unlock the attachment means, and from removable attachment means. The use of one configuration rather than another depends on the problems being addressed.

The prior art discloses a system for attaching a pump on a neck of a reservoir configured to facilitate the recycling of the system once it is disassembled. The attachment system is provided with a sleeve, a collar mounted around the sleeve and able to move partially following a helical motion about the sleeve by actuating a shrink ring. The sleeve is configured so that unscrewing the attachment system requires the application of a threshold force by the user, thanks to the presence of lugs. When the disassembly position is reached, the collar remains in disassembly position on the sleeve while the pump can be removed, either enabling to recycle the vial without the pump, or allowing the user to refill the reservoir. To reassemble the pump, i.e. return it to a position of use, the user has to screw the collar back on. However, the lugs enabling to calibrate the unscrewing force that needs to be applied are configured so that reassembly is nearly impossible, or in any case very difficult. Furthermore, even if the user were able to put the pump back in position, the user would have had to perform a screwing motion.

BRIEF SUMMARY OF THE INVENTION

The present invention provides an attachment system that enables, after filling of the reservoir, to reassemble the pump by screwing, but also and more importantly, by simple pressure on the shrink ring, and therefore proposes a system for attaching a dispensing pump on the neck of a reservoir containing a fluid product, the system including:

a sleeve including attachment means on the neck and hooking means of the pump;

an articulation collar, the articulation collar and the sleeve being mounted mobile with respect to one another between an end of motion position and a start of motion position;

a shrink ring configured to move the articulation collar from a top disassembly position, wherein the attachment means are free, to a bottom position of use, wherein the attachment means are gripped about the neck.

This attachment system is characterised in that the start and end of motion positions are arranged so that the articulation collar can go from the top disassembly position to the bottom position of use by following a translational motion.

The idea of the invention is to enable the reassembly of the pump by means of simple actions, i.e. a translational motion, while retaining the advantages of an attachment system including a sleeve, an articulation collar and a shrink ring. In this context, the start and end of motion positions are each advantageously located in the axial extension of the other so that the articulation collar is able to slide from the end of motion housing towards the start of motion housing by means of a translational motion, and so that the reassembly of the pump is also possible by simple pressure exerted by the user. Furthermore, once back in place, the system is returned to a start of motion position, and another disassembly/reassembly cycle can be restarted.

According to different characteristics of the invention, which can be taken together or separately:

- the articulation collar and the sleeve are in abutment at the level of the end of motion position in a top disassembly position;
- the articulation collar and the sleeve are in abutment at the level of the start of motion position in a bottom position of use;
- the attachment system includes a guiding collar;
- the articulation collar is mounted around the guiding collar;
- the sleeve includes the first translational guiding means of the articulation collar from the top disassembly position towards the bottom position of use, located in particular at the level of the guiding collar;
- the first translational guiding means include a start of motion housing located at the start of motion position;
- the first translational guiding means include an end of motion housing located at the end of motion position;
- the first translational guiding means include a first locking means;
- the start and end of motion housings are connected by means of the first locking means;
- the first locking means is configured to authorise the translational displacement of the articulation collar from the top disassembly position to the bottom position of use by application of a threshold pressure;
- the first locking means forms a boss;
- the first locking means includes a portion retaining the articulation collar in a top disassembly position;
- the retaining portion is located in the extension of the end of motion housing;
- the first locking means includes an edge locking the articulation collar in a bottom position of use;
- the locking edge forms an abutment for the articulation collar in the start of motion housing;
- the retaining portion and the locking edge are connected by a ridge of the first locking means;

the articulation collar is able to slide along the first guiding means following a translational motion, in particular on the retaining portion and then on the ridge;

the sleeve further includes second guiding means of the articulation collar, the second guiding means including at their ends the start and end of motion positions;

the articulation collar is able to perform a rotational or translational motion, in particular, a screwing motion around the sleeve;

the second guiding means include a helical segment;

the second guiding means include second locking means separating the end and start of motion housings from the helical segment;

the second locking means are configured to allow the rotational motion of the articulation collar around the sleeve by applying a threshold pressure;

the second locking means form well-defined abutments;

the articulation collar includes a protrusion that is able to move along the first and second translational and rotational guiding means;

the shrink ring includes an inner wall that includes ribs;

the ribs are angularly distributed on a circumference of the inner wall, so that the shrink ring is tightened on the articulation collar;

the sleeve includes an attachment skirt on the collar, the shrink ring being configured to immobilise the skirt on the collar in a bottom position and to release the skirt in a top position.

The invention further relates to a vial for dispensing a fluid product, including a reservoir for the fluid product, the reservoir being provided with a neck defining an opening of the reservoir, the vial further including a dispensing pump and an attachment system such as described above, the system enabling the attachment of the pump on the neck. Furthermore, the dispensing vial is provided with an anti-rotation system of the attachment system.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
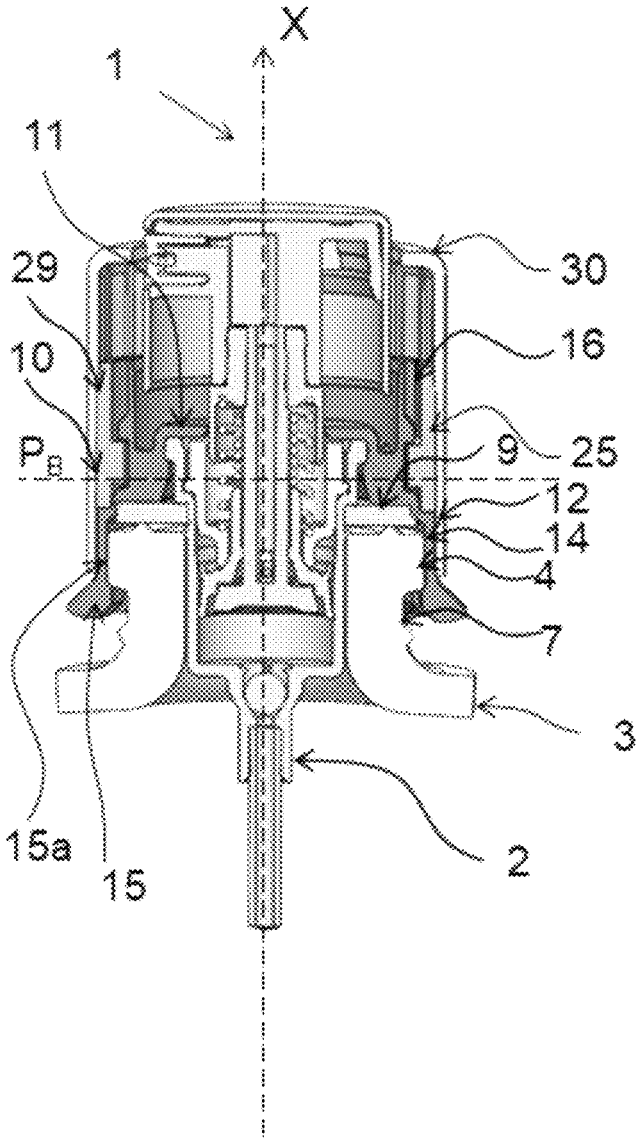
FIG. 1 illustrates a longitudinal cross-section view of a dispensing head mounted on a neck of a reservoir of a vial of fluid product and equipped with an attachment system for a pump according to the invention, prior to the initial assembly.

With reference to FIG. 1, the invention relates to a vial for dispensing a fluid product including a reservoir 3, and a dispensing head 1 of the fluid product contained in the reservoir 3.

The fluid product can be a cosmetic product, a pharmaceutical product or any other type of product that can usefully be kept in a vial. The fluid can be in direct contact with the reservoir 3. However, the fluid can be contained in a soft pouch located within the reservoir 3 so that it is not in contact with the reservoir 3 but with the soft pouch.

The reservoir 3 can be either rigid or deformable. However, the reservoir 3 includes, at the level of an upper part, a neck 4 and an opening 5 formed in the neck 4. The neck 4 is preferably rigid. It forms a channel 7 with the reservoir 3 and a peripheral edge 6 surmounting the channel 7.

The dispensing head 1 is equipped with a dispensing pump 2 of the fluid product contained in the reservoir 3. At the output of the pump, the dispensed fluid is in particular liquid, viscous or pasty. The dispensing pump 2 includes a body that extends along a central longitudinal axis X corresponding to a median axis of the vial. In particular, the body has a tubular shape of revolution. During use, the dispensing pump 2 is maintained fixed at the level of the neck 4 by means of an attachment system according to the invention. However, the dispensing pump 2 can be removed from the location by means of the attachment system, for the purpose of filling the reservoir 3 for instance. In other words, the dispensing pump 2 is removable.

The attachment system according to the invention includes an attachment sleeve 10, an articulation collar 25 and a shrink ring 30. The articulation collar 25 and the sleeve 10 are mounted mobile with respect to one another from a start of motion position $P_I$ (illustrated in FIG. 1) and an end of motion position $P_F$ (illustrated in FIG. 3). The kinematics of the displacement of the articulation collar 25 with respect to the sleeve 10 are described in further detail below. The shrink ring 30 is configured to actuate a displacement of the articulation collar 25 with respect to the sleeve 10. It also has a decorative purpose, its external surface being visible to the user.

In the embodiment illustrated in FIG. 1, the sleeve 10 has a generally cylindrical shape and extends along the axis X. The sleeve 10 is hollow. It defines an empty inner volume that essentially serves to house the dispensing pump 2. However, the pump 2 extends axially beyond the ends of the sleeve 10. The sleeve 10 is provided with hooking means 11 of the dispensing pump 2. The hooking means 11 enable to maintain the pump 2 still at the level of the neck 4, for example in an extended manner thanks to a seal 9.

The sleeve 10 includes a skirt 12 configured to engage with the neck 4. In this context, the skirt 12 includes a flat portion 14 able to surround the peripheral edge 6, possibly in tightening. The skirt 12 further includes attachment means 15 to the neck 4 that extend in the extension of the flat portion 14.

Preferably, the attachment means 15 consist of flexible tabs able to move independently from one another. Preferably, these flexible tabs 15 are evenly spaced from one another all around the skirt 12, i.e. the flexible tabs are at a constant distance from one another. Preferably, also, the flexible tabs 15 are connected to the flat portion 14 by means of a hinge portion 15*a*. They alternate between a release position, wherein they are free, i.e. they are not engaged with the neck 4, and an engaged position wherein they engage with the neck 4. The flexible tabs 15 feature, on their internal faces, i.e. on the faces oriented towards the neck 4, a form that substantially fits with the form of the channel 7. In the configuration illustrated in FIG. 1, the flexible tabs 15 are in a release position, i.e. they are not engaged in the channel 7.

The sleeve 10 further includes a guiding collar 16, the main purpose of which is to guide the articulation collar 25 in its movements. More specifically, the articulation collar 25 is mounted mobile around the guiding collar 16. In other words, it is able to move with respect to the guiding collar 16. The guiding collar 16 includes guiding means of the articulation collar 25, which are described in further detail below. The articulation collar 25 includes displacement means along the guiding means of the guiding collar 16. The guiding collar 16 and the articulation collar 25 therefore form a mobile mechanical assembly. The guiding collar 16 is located in the longitudinal extension of the skirt 12.

The shrink ring 30 has a generally cylindrical shape. As mentioned above, it is configured to actuate the displacement of the articulation collar 25. For this purpose, it includes an inner wall 31 whereon are angularly distributed the ribs 32. The ribs are more specifically arranged on an upper portion of the shrink ring 30, along which the articulation collar 25 is able to move. The ribs 32 enable to secure the shrink ring 30 to the articulation collar 25. Specifically, in the embodiment illustrated in FIGS. 1 to 3, it can be seen that the ribs 32 (visible in FIG. 1) are integrated in an outer wall 29 of the articulation collar 25, which enables the tightening and therefore the securing of the shrink ring 30 around the articulation collar 25. This also ensures that the articulation collar 25 is reliably driven by the shrink ring 30.

Furthermore, the shrink ring 30 is configured to perform a translational motion. This translational motion of the shrink ring 30 is made possible by the configuration of the articulation collar 25 with respect to the skirt 12. For this purpose, the outer wall 29 of the articulation collar 25 is here substantially aligned with the flat portion 14 of the skirt 12, so that the shrink ring 30 is always maintained pressed against the outer wall 29 and against the flat portion 14. Incidentally, the shrink ring 30 is therefore able to move longitudinally, in particular from a proximal position to a distal position with respect to the sleeve 10, by driving the articulation collar 25.

With this configuration, the shrink ring 30 is adapted to actuate the displacement of the articulation collar 25 between a top disassembly position $P_H$ and a bottom position $P_B$ of use. For the articulation collar 25 to be able to reach the top disassembly position $P_H$, the shrink ring 30 must move to its distal position. Similarly, for the articulation collar 25 to be able to reach its bottom position of use $P_B$, the shrink ring 30 must move to its proximal position. It should be noted that in the configuration shown in FIG. 1, the articulation collar 25 is neither in a top disassembly position $P_H$ nor in a bottom position $P_B$ of use, but in a position prior to the initial assembly.

Figure 2:
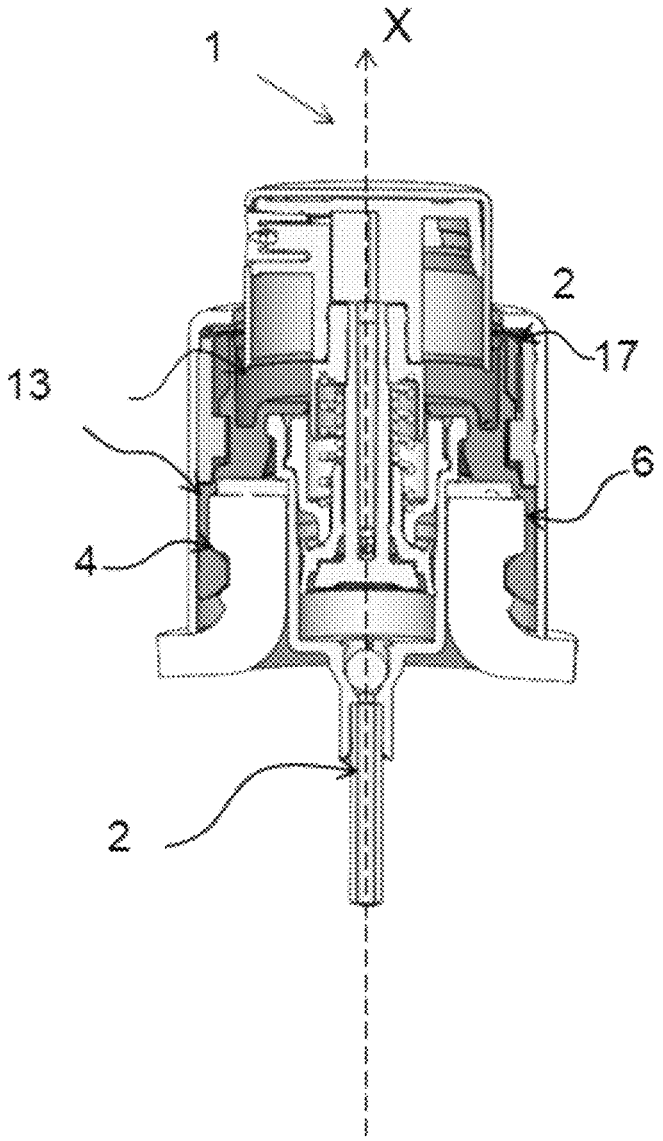
FIG. 2 shows the elements of FIG. 1 after the assembly of the attachment system on the neck.

With reference to FIG. 2, the articulation collar 25 is in the bottom position $P_B$ of use. When the articulation collar 25 is in that position, the attachment system is rigidly secured around the neck 4 and the vial is ready to be used. Indeed, in this configuration, the shrink ring 30 being located in the proximal position and being therefore fully lowered, its inner wall 31 exerts a radial pressure on the attachment means 15, which are in an engaged position. In other words, the attachment means 15 are engaged with the neck 4. Specifically, the outer faces of the flexible tabs 15 are vertically aligned with the flat portion 14, whereas their inner faces are fully engaged in the channel 7 of the neck. It should be noted that the channel 7 includes a recess 8. The recess 8 forms an anti-rotation system of the attachment system wherein one or several tabs 15 can be housed.

Figure 3:
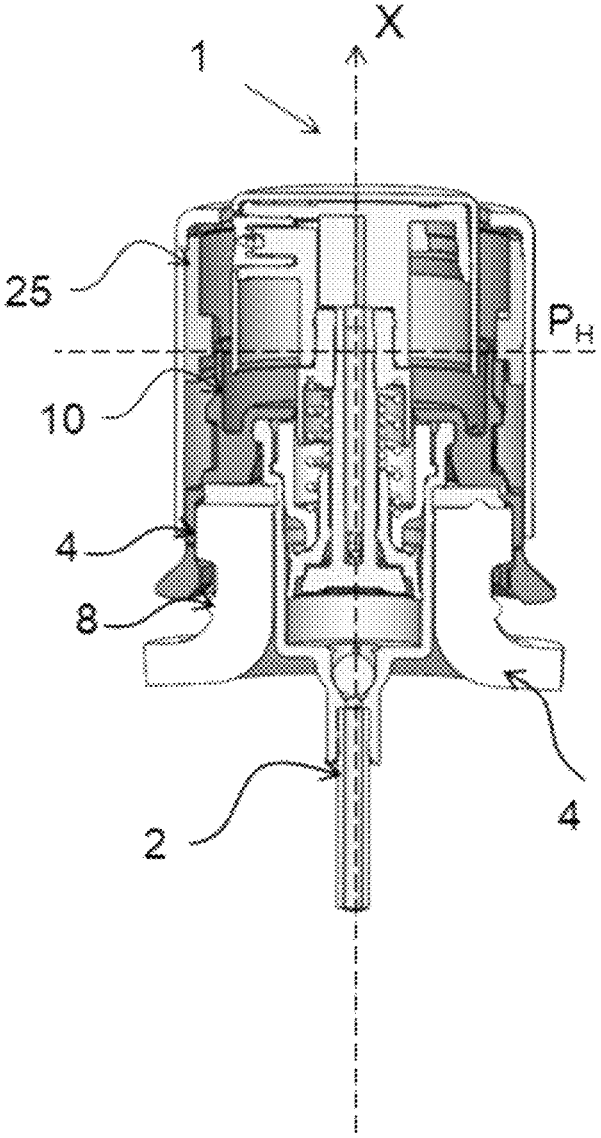
FIG. 3 shows FIGS. 1 and 2 in a position where the attachment system can be removed from the neck; after a first use, it is mounted back on the neck for a subsequent use.

With reference to FIG. 3, the articulation collar 25 is in the top disassembly position $P_H$. When the articulation collar 25 is precisely in that position, the attachment system is no longer engaged with the neck 4. As necessary, the user can refill the reservoir 3 if the fluid product being used is suitable for this type of operation. In this configuration, the shrink ring 30 being located in the distal position and being therefore fully raised, its inner wall 31 no longer exerts any pressure on the attachment means 15, which releases the attachment means 15. Specifically, the soft tabs 15 are in a released position. In other words, the soft tabs 15 are free.

As mentioned above, FIG. 1 illustrates the vial before the initial attachment of the dispensing head 1 on the reservoir. Such an operation is performed, for example, at the industrial facilities where the vial is initially filled.

In this configuration, the sleeve 10 is mounted on the neck 4, the flexible tabs 15 being free. The articulation collar 25 is in a bottom position $P_B$ of use. The shrink ring 30 is in a retracted position corresponding to the top disassembly position $P_H$ of FIG. 3 but without the shrink ring being tightened on the articulation collar 25, thereby enabling the flexible tabs 15 to be free and the dispensing head 1 to be mounted on the reservoir.

Once the dispensing head 1 is in position, the shrink ring 30 is forcibly lowered along a translational motion and the dispensing head switches to the configuration shown in FIG. 2. This translational motion is facilitated by ribs 32 that are specifically provided to guide the articulation collar 25.

With reference to FIGS. 2 and 3, the kinematics of the displacement of the articulation collar 25 with respect to the sleeve 10 is described below.

Passage of the articulation collar 25 from the top disassembly position $P_H$ to the bottom position $P_B$ of use Preferably, when the articulation collar 25 is located in a top disassembly position $P_H$ (FIG. 3), it is abutment against the sleeve 10 at the level of an end of motion position $P_F$. Preferably, equally, when the articulation collar 25 is located in a bottom position $P_B$ of use (FIG. 2), it is abutment against the sleeve 10 at the level of the start of motion position $P_I$. As mentioned above, to prevent unwanted disassembly when the vial is in use, the devices of the prior art are configured so that the user has to unscrew the articulation collar 25 of the sleeve 10. The subsequent reassembly, if authorised, is performed by re-screwing.

Alternatively, the articulation collar 25 and the sleeve 10 can abut, without one of the parts necessarily being encased in the other. In other words, there can be a clearance between the articulation collar 25 and the sleeve 10.

According to the invention, the start and end of motion positions $P_I$, $P_F$ are arranged so that the articulation collar 25 is able to pass from the top disassembly position $P_H$ (as seen in FIG. 2) to the bottom position $P_B$ of use (as seen in FIG. 3) by a translational motion. Thus, even when the disassembly of the attachment system is achieved, for instance, by unscrewing, the attachment system can be reassembled on the neck 4 of the reservoir 3 by a simple translational motion, and therefore by simple pressure by the user. No screwing is therefore necessary for the reassembly.

Figure 4A:
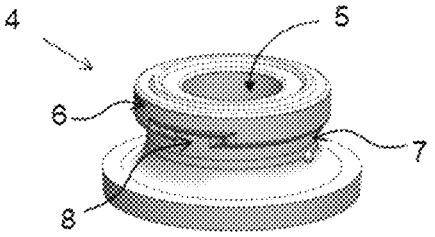
FIG. 4*a* is a perspective and exploded view of the attachment system including a sleeve (FIG. 4*b*), the articulation collar (FIG. 4*c*) and a shrink ring (FIG. 4*d*). On FIG. 4*a* is illustrated a neck for the attachment of the attachment system.
Figure 4B:
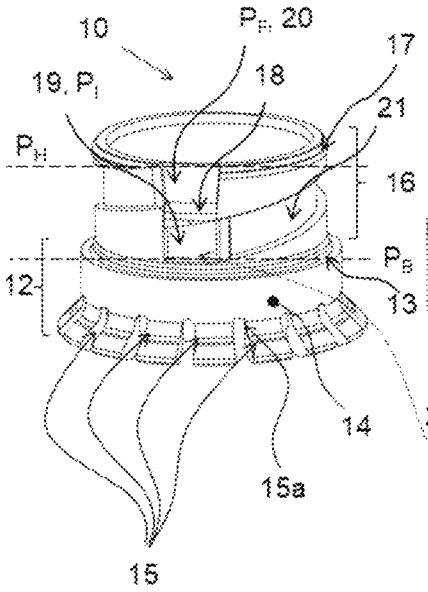

With reference to FIG. 4*b*, the sleeve 10 advantageously includes first translational guiding means of the articulation collar 25 from the top disassembly position $P_H$ to the bottom position $P_B$ of use. The first translational guiding means are located on the guiding collar 16. They extend along the start of motion position $P_I$ and the end of motion position $P_F$. It is preferable that there are at least two of these first translational guiding means. It ensures that the articulation collar 25 is reliably displaced with respect to the sleeve 10.

Advantageously, these first translational guiding means include a start of motion housing 19 located at the start of motion position $P_I$ and an end of motion housing 20 located at the end of motion position $P_F$. The start and end of motion housings 19, 20 form together a groove or a notch that has a substantially rectangular hold on the guiding collar 16. As illustrated in FIG. 4*b*, the groove extends longitudinally over the entire length of the guiding collar 16, i.e. between a free upper edge of the guiding collar 16 and the skirt 12. The height of the guiding collar 16 therefore corresponds substantially to the longitudinal distance that the articulation collar 25 can travel during its motion from the top disassembly position $P_H$ to its bottom position $P_B$ of use. Furthermore, the skirt 12 forms an outer ledge 13 whereon the lower edge of the articulation collar 25 comes to rest when it is in the bottom position $P_B$ of use. The outer ledge 13 contributes to blocking the translational motion of the articulation collar 25.

It should also be noted that the end of motion housing 20 includes a flat end 20*a* forming a discontinuity at the level of the upper free edge of the guiding collar 16. This enables in particular to position the articulation collar 25 with respect to the guiding collar 16 and facilitates the initial assembly of the articulation collar on the sleeve 10.

Each of the first translational guiding means further includes a first locking means 18. The start and end of motion housings 19, 20 are connected by means of the first locking means 18. Any translational motion of the articulation collar 25 from its top disassembly position $P_H$ to its bottom position $P_B$ of use implies that the articulation collar 25 is able to pass over the first locking means 18.

The first locking means 18 is configured to authorise the translational displacement of the articulation collar 25 from the top disassembly position $P_H$ to the bottom position $P_B$ of use by a translational motion generated by the application of a threshold pressure. Thus, the actions the user has to perform are simple as they require a simple pressure and, at the same time, the motion of the articulation collar 25 from the top disassembly position $P_H$ to the bottom position $P_B$ of use cannot result from accidental pressure, but rather from the intention of the user to close the vial.

Advantageously, the first locking means 18 forms a boss, i.e. excessive thickness between the start and end of motion housings 19, 20.

Preferably, the first locking means 18 includes a retaining portion 18*a*. The retaining portion 18*a* forms a ledge for the articulation collar 25 when the latter is in its top disassembly position $P_H$. The retaining portion 18*a* is at an angle with respect to a bottom of the groove. More specifically, it forms an obtuse angle with the end of motion housing 20. With this configuration, the retaining portion 18*a* enables to maintain the articulation collar 25 as well as its sliding along the groove, and therefore from the end of motion position $P_F$ to the start of motion position $P_I$.

Furthermore, the first locking means 18 includes a locking edge 18*b*. This locking edge 18*b* extends from the bottom of the groove along a plane that is transversal to the direction of the axis X. More specifically, it forms a right angle with the start of motion housing 19. Thus, when the articulation collar 25 has reached its bottom position $P_B$ of use, it cannot return to the top disassembly position $P_B$ by a translational motion along the groove. The locking edge 18*b* therefore forms an upper abutment for the articulation collar 25 in a bottom position $P_B$ of use.

The first locking means 18 includes a ridge 18*c* by which the retaining portion 18*a* is connected to the locking edge 18*b*. The ridge 18*c* can be assimilated to a summit of the boss 18. In the embodiment of FIG. 4*b*, the ridge 18*c* has a height, called protruding height, substantially equal to the depth of the groove with respect to an external circumference of the guiding collar 16. This aspect is not mandatory. The protruding height defines the pressure that must be applied to the articulation collar 25 to overcome the first locking means 18 and reach the start of motion housing 19. It should be understood that the greater the protruding height, the greater the required pressure.

Thus, when the articulation collar 25 slides from the end of motion housing 20 towards the start of motion housing 19, it passes in succession over the retaining portion 18*a* and the ridge 18*c*.

Figure 4C:
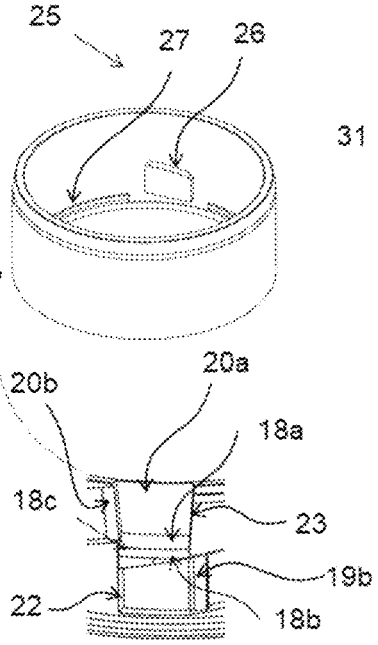
Figure 4D:
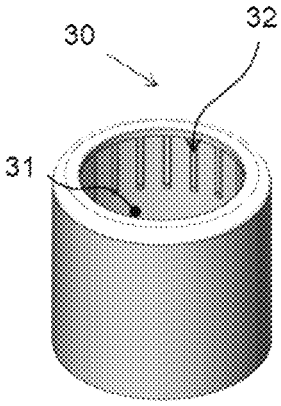

With reference to FIG. 4*c*, the articulation collar 25 presents itself in the form of a hollow cylinder. This is not a limiting aspect in the context of the present invention. In any case, the shape of the articulation collar 25 has to fit with the shape of the sleeve 10 since the articulation collar 25 is mounted mobile around the sleeve 10. The articulation collar 25 includes a protrusion 26 that is able to move along the first and second translational and rotational guiding means. The protrusion 26 extends radially from an inner wall of the articulation collar 25. It presents a generally rectangular shape, although this aspect is not mandatory. This shape is adapted to the shape of the guiding means along which the protrusion has to travel. More specifically, the lateral sides, oriented longitudinally, of the protrusion 26 slide against the lateral sides, oriented longitudinally, of the groove formed by the housings 19, 20.

The articulation collar 25 features an inner strip 27 able to come and bear against an excess thickness 17 of an upper edge of the sleeve 10. Thus, when the articulation collar 25 is in a top disassembly position $P_H$, it is configured to stay at the level of the end of motion position 20, so that the articulation collar 25 is maintained at the level of the sleeve 10. When the articulation collar 25 is in a bottom position $P_B$ of use, a lower edge of the articulation collar is able to come and bear against the outer ledge 13.

Passage of the articulation collar 25 from the bottom position $P_B$ of use to the top disassembly position $P_H$ With reference to FIG. 4*b*, the sleeve 10 can include, in addition to the first translational guiding means, second guiding means of the articulation collar 25. These second guiding means enable the articulation collar 25 to be screwed onto and unscrewed from the sleeve 10.

Similarly to the first translation guiding means, these second guiding means are positioned on the guiding collar 16. Preferably, they extend from the start and end of motion positions $P_I$, $P_F$. Each one includes at its ends a start of motion housing 19 and an end of motion housing 20. It should be understood that the fact that there are two second guiding means implies that there are four housings in all, as each of the second guiding means includes a start of motion housing 19 and an end of motion housing 20, in the longitudinal extension of one another, in pairs.

The attachment system according to the invention is particularly ingenious. Indeed, the start and end of motion housings 19, 20 in the second guiding means are the same housings that form the first translational guiding means, specifically the groove. The architecture of the guiding means is thus optimised to enable both the reassembly of the attachment system by simple pressure by the user, but also the screwing and unscrewing of the system. With reference to the abovementioned example, it should be understood that the fact that there are four housings in all means that there are two first translational guiding means, each being formed of a start of motion housing 19 and an end of motion housing 20. However, in this configuration, as will be better understood in the following description, the end of motion housing 20 of a second guiding means does not form a groove with the start of motion housing 19 of the same second guiding means.

The second guiding means are configured so that the articulation collar 25 is able to perform a translational and rotational motion, in particular a screwing motion about the sleeve 10 for the purpose of disassembling the attachment system.

For this purpose, each of the second guiding means includes advantageously a helical segment 21. Each helical segment 21 includes a first end 22 including a start of motion housing 19 and a second end 23 including the end of motion housing 20. Preferably, there are at least two second guiding means. However, this number is not limiting.

Let us consider that the sleeve 10 includes n, n being a natural integer, second guiding means each including a helical segment $\mathbf{21}_1, \ldots, \mathbf{21}_i, \mathbf{21}_{i+1}, \ldots, \mathbf{21}_n$, i being a natural integer with $i \geq 1$ and $i+1 \leq n$. Each of these helical segments $\mathbf{21}_1, \ldots, \mathbf{21}_j, \mathbf{21}_{i+1}, \ldots, \mathbf{21}_n$, i being a natural integer where $i<n$, includes respectively a first end $\mathbf{22}_1, \ldots, \mathbf{22}_i, \mathbf{22}_{i+1}, \ldots, \mathbf{22}_n$ and a second end $\mathbf{23}_1, \ldots, \mathbf{23}_i, \mathbf{23}_{i+1}, \ldots, \mathbf{23}_n$. The second guiding means are configured so that the first end $\mathbf{22}_1$ of a first helical segment $\mathbf{21}_1$ is located opposite the second end $\mathbf{23}_n$ of a last helical segment $\mathbf{21}_n$ and so that each of the other first ends $\mathbf{22}_{i+1}$ of the helical segments is located opposite the other second ends $\mathbf{23}_i$ of the helical segments that precede them. In fact, the first ends $\mathbf{22}_1, \ldots, \mathbf{22}_i, \mathbf{22}_{i+1}, \ldots, \mathbf{22}_n$ form with the second ends $\mathbf{23}_1, \ldots, \mathbf{23}_i, \mathbf{23}_{i+1}, \ldots, \mathbf{23}_n$ the housings of the first translational guiding means, specifically grooves, which implies that the attachment system according to the invention is a system that is both convenient and ingenious.

In the specific case where n equals one, there is a single guiding means including a helical segment 21. In this case, it should be understood that the ends of the helical segment 21 also form the start and end of motion housings 19, 20 of the groove, enabling the articulation collar 25 to pass from a top disassembly position $P_H$ to the bottom position $P_B$ of use.

In the specific case of n being equal to two, the first helical segment $\mathbf{21}_1$ performs a half-turn of the guiding collar 16 and the second helical segment $\mathbf{21}_2$ performs a remaining half-turn of the guiding collar 16. In this configuration, the first end $\mathbf{22}_1$ of the first helical segment $\mathbf{21}_1$ is located opposite the second end $\mathbf{23}_2$ of the second helical segment $\mathbf{21}_2$ and the first end $\mathbf{22}_2$ of the second helical segment $\mathbf{22}_5$ is located opposite the second end $\mathbf{23}_1$ of the first helical segment. The first end $\mathbf{22}_1$ and the second end $\mathbf{23}_2$ form the housings of a first translational guiding means, whereas the first end $\mathbf{22}_2$ and the second end $\mathbf{23}_1$ form the housing of a second translational guiding means.

Preferably, each second guiding means includes second locking means 19*b*, 20*b* separating the end and start of motion housings 19, 20 from the helical segment 21. The second locking means 19*b*, 20*b* consist of bosses or excessive thicknesses of which a protruding height determines the pressure that must be applied so that the articulation collar 25, in particular the protrusion 26, leaves the start or end of motion housing 19, 20 to reach the helical segment 21. In other words, the second locking means 19*b*, 20*b* are configured to allow the rotational motion of the articulation collar 25 around the sleeve 10 by applying a threshold pressure.

In a preferred embodiment, the excessive thickness 20*b* forms a well-defined abutment (as illustrated in FIG. 4*b*). In other words, it also prevents screwing the articulation collar 25 around the sleeve 10, even if a lot of pressure is exerted. In this configuration, the protrusion 26 cannot leave the end of motion housing 20 to reach the helical segment 21. It should therefore be understood that only the translational motion of the protrusion 26 from the end of motion housing 20 towards the start of motion housing 19 is authorised to reach the bottom position $P_B$ of use.

In a preferred embodiment, the excessive thickness 20*b* is configured so that the unscrewing of the articulation collar 25 around the sleeve 10 is authorised by applying a threshold pressure (as illustrated in FIG. 4*b*).

It should be understood that when the protrusion 26 moves from the start of motion housing 19 towards the end of motion housing 20 passing over the excessive thickness 19*b*, along the helical segment 21 and over the excessive thickness 20*b*, in this order, the operation is an unscrewing operation. The articulation collar 25 therefore passes from the bottom position $P_B$ of use to the top disassembly position $P_B$ by unscrewing. It is worth remembering that this is the only possible alternative as it is not possible to disassemble the attachment system by a translational motion, in particular because of the abutment 18*b*. Alternatively, when the protrusion 26 moves from the end of motion housing 20 towards the start of motion housing 19 passing over the excessive thickness 20*b*, along the helical segment 21 and over the excessive thickness 19*b*, in this order, the operation is a screwing operation. The articulation collar 25 therefore passes from the top disassembly position $P_H$ to the bottom position $P_B$ of use by screwing. This is not a mandatory aspect of the present invention as the first translational guiding means enable to pass from the top disassembly position $P_H$ to the bottom position $P_B$ of use by translational motion of the articulation collar 25.

In other words, although the reassembly of the attachment system is possible by simple translational motion of the articulation collar 25 from the top disassembly position $P_H$ to the low position $P_B$ of use, it is also possible to mount the attachment system by screwing. This provides it with great flexibility of use.

Of note, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes", and/or "including," when used in this specification, specify the presence of stated features, integers, steps, operations, elements, and/or components, but do not preclude the presence or addition of one or more other features, integers, steps, operations, elements, components, and/or groups thereof.

As well, the corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

The invention claimed is:

1. A system for attaching a dispensing pump on a neck of a reservoir containing a fluid product, said system comprising:

a sleeve comprising attachment means on said neck and hooking means of the pump;

an articulation collar, said articulation collar and the sleeve being mounted mobile one with respect to the other between an end of motion position and a start of motion position;

a shrink ring configured to move said articulation collar between a top disassembly position, wherein said attachment means are free, and a bottom position of use, wherein said attachment means are engaged around said neck;

wherein said start and end of motion positions are arranged so that the articulation collar is able to pass from the top disassembly position to the bottom position of use by a translational motion.

2. The system according to claim 1, wherein the sleeve comprises first translational guiding means of said articulation collar from the top disassembly position to the bottom position of use.

3. The system according to claim 2, wherein the first translational guiding means comprise a start of motion housing located at the start of motion position and an end of motion housing located at the end of motion position, the start and end of motion housings being located in an extension of one another.

4. The system according to claim 3, wherein the first translational guiding means comprise a first locking means, said start and end of motion housings being separated by said first locking means, said first locking means being configured to authorize the translational displacement of said articulation collar from the top disassembly position to the bottom position of use by application of a threshold pressure.

5. The system according to claim 4, wherein said first locking means forms a boss.

6. The system according to claim 2, wherein the sleeve further comprises second guiding means of the articulation collar comprising at their ends said start and end of motion positions and wherein the articulation collar comprises a protrusion able to move along said first and second guiding means.

7. The system according to claim 3, wherein the sleeve further comprises second guiding means of the articulation collar comprising at their ends said start and end of motion positions and wherein the second guiding means comprise a helical segment and second locking means separating the start and end of motion housings of said helical segment.

8. The system according to claim 7, wherein said second locking means are configured to allow the rotational motion of the articulation collar around said sleeve by applying a threshold pressure.

9. The system according to claim 7, wherein said second locking means forms a well-defined abutment.

10. The system according to claim 4, wherein said first locking means comprises a retaining portion of the articulation collar in the top disassembly position, said retaining portion being located in the extension of said end of motion housing.

11. The system according to claim 4, wherein said first locking means comprises a locking edge of the articulation collar in the bottom position of use, said locking edge forming an abutment for said articulation collar in the start of motion housing.

12. The system according to claim 1, wherein the sleeve further comprises second guiding means of the articulation collar comprising at their ends said start and end of motion positions.

13. The system according to claim 1, wherein the shrink ring comprises an inner wall comprising ribs distributed angularly over a circumference of said inner wall so that said shrink ring is adjusted and tightened on said articulation collar.

14. A vial for dispensing a fluid product, comprising:

a reservoir for the fluid product, said reservoir being provided with a neck defining an opening of said reservoir, said vial further comprising a dispensing pump and an attachment system enabling attachment of said pump on said neck, said attachment system comprising:

a sleeve comprising attachment means on said neck and hooking means of the pump;

an articulation collar, said articulation collar and the sleeve being mounted mobile one with respect to the other between an end of motion position and a start of motion position;

a shrink ring configured to move said articulation collar between a top disassembly position, wherein said attachment means are free, and a bottom position of use, wherein said attachment means are engaged around said neck;

wherein said start and end of motion positions are arranged so that the articulation collar is able to pass from the top disassembly position to the bottom position of use by a translational motion.

15. The vial according to claim 14, wherein said neck is provided with an anti-rotation system of said attachment system.

* * * * *